US006146315A

United States Patent [19]

Schönenberger

[11] Patent Number: 6,146,315

[45] Date of Patent: Nov. 14, 2000

[54] TREADMILL

[75] Inventor: Willi Schönenberger, Schönenberg, Switzerland

[73] Assignee: Woodway AG, Schonenberg, Switzerland

[21] Appl. No.: 08/943,389

[22] Filed: Oct. 3, 1997

[30] Foreign Application Priority Data

Oct. 29, 1996 [DE] Germany ..... 296 18 849

[51] Int. Cl.[7] ..... A63B 22/00

[52] U.S. Cl. ..... 482/69; 482/54

[58] Field of Search ..... 482/69, 54

[56] References Cited

U.S. PATENT DOCUMENTS

| | | | |
|---|---|---|---|
| 4,635,928 | 1/1987 | Ogden et al. . | |
| 4,655,447 | 4/1987 | Dubrinsky et al. | 482/54 |
| 4,842,266 | 6/1989 | Sweeney, Sr. et al. | 272/69 |
| 5,000,440 | 3/1991 | Lynch . | |
| 5,603,677 | 2/1997 | Sollo | 482/69 |
| 5,788,606 | 8/1998 | Rich | 482/27 |

FOREIGN PATENT DOCUMENTS

| | | |
|---|---|---|
| 2 252 108 | 11/1973 | France . |
| 21 51 933 | 12/1972 | Germany . |
| 25 03 118 B2 | 4/1976 | Germany . |
| 42 38 252 C2 | 5/1994 | Germany . |
| 2 152 825 | 8/1985 | United Kingdom . |
| WO 93/14733 | 8/1993 | WIPO . |
| WO 96/09094 | 3/1996 | WIPO . |

*Primary Examiner*—Glenn E. Richman
*Attorney, Agent, or Firm*—Seed IP Law Group PLLC

[57] ABSTRACT

The present invention refers to a treadmill comprising a moving belt and holding means with the aid of which the weight of the user's body can be counterbalanced at least partially, said invention providing the feature that said holding means include at least one support means for weights which can be added one by one and which serve as counter-weights.

7 Claims, 2 Drawing Sheets

TREADMILL

TECHNICAL FIELD

The present invention refers to a treadmill comprising a moving belt and holding means for the user with the aid of which the weight of the user's body can partially be counterbalanced.

BACKGROUND OF THE INVENTION

Treadmills are used e.g. for physical training and for rehabilitation and therapy, respectively. Such treadmills are described e.g. in DE 25 03 118 B2 and DE 42 38 252 C2. An endless moving belt running over two cylinders serves as a running surface in such treadmills.

Such treadmills are also used for therapeutic and rehabilitation purposes. For this purpose, additional belts have been used, which hold the user or the patient and which partially counterbalance the weight of his body so that the patient can safely walk on the moving belt.

These belts can e.g. be used for raising a patient to a suitable position from a wheelchair. The belt holding force of these holding means can simultaneously be adjusted such that the weight of the patient's body or the weight of the user's body is counterbalanced at least partially. Patients or users suffering e.g. from back injuries can train their walking ability in this way without having to bear the weight of their body. In the course of the therapy, various body weight loads can then be adjusted.

Such treadmills provided with the above-mentioned holding means are disadvantageous insofar as the body weight is counterbalanced once and the body load is adjusted once at the beginning of the use of the treadmill when a treatment is started, the adjusted values remaining constant during the individual treatment. The level on which the user is held can then no longer be changed. When the user or the patient is walking or running on the moving belt, this will, however, result in up and down movements of his body which cannot be compensated for by such holding means, since said holding means are adjusted to a constant level.

SUMMARY OF THE INVENTION

Hence, it is the object of the present invention to provide a treadmill comprising holding means in the case of which the weight of the patient's body or the weight of the user's body can constantly be counterbalanced when the patient or user is walking or running, in spite of the up and down movement caused during such walking and running, and in the case of which the load can be adjusted to a constant value.

This object is achieved by a treadmill having the features of embodiment of the present invention.

In accordance with the present invention, the holding means include at least one support means for weights which can be added one by one and which serve as counterweights. These weights establish a freely selectable but then constant counterweight which does not change due to the up and down movement of the patient or user when said patient or user is walking or running. In this way, the body-weight reduction is maintained constant independently of the movement, and the applicability and efficiency of the treadmill is improved.

In accordance with an advantageous embodiment, means for safely positioning the user are additionally provided. With aid of such means, the patient or user can be brought to the correct position before the treatment begins and before the weight of his body is counterbalanced or partially counterbalanced with the aid of the weights.

Such means for safely positioning the user can comprise a first rope means which is held by at least one first crane-like cantilever frame via at least one first deflection pulley. With the aid of such a rope means and a complementary deflection pulley, a patient can be brought to an upright position very easily and safely.

In accordance with an advantageous embodiment, the holding means, with the aid of which the weight of the user's body can be counterbalanced at least partially, can comprise a second rope means which is held on a second crane-like cantilever frame by at least one second deflection pulley, the weight of the user acting on one end of the rope means and the support means with the individually dosed weights acting on the other end thereof, when the treadmill is in operation. This type of arrangement-guarantees a simple structural design and a good operability, and it guarantees that the weights can easily be dosed.

It is desirable that the first and second crane-like cantilever frames are defined by a single crane-like frame having secured thereto said first and second deflection pulleys. In this way, a simple structural design of the treadmill is guaranteed.

In accordance with a simple embodiment, said holding means comprise a connection means including a chest belt, an abdominal belt or a seat belt. A connection means of this type serves to hold the patient or user safely.

In accordance with an advantageous embodiment, a third deflection pulley is provided, which has the connection means secured thereto, said connection means being connected to said first and second rope means and said first and second rope means being interconnected in such a way that the user is held by an overall rope means connection extending from the support means of the counterweights via the second deflection pulley, the third deflection pulley and the first deflection pulley. According to this embodiment, the user or patient is held with the aid of an arrangement resembling a pulley block. The weight compensation effect can be dosed more precisely and, due to the overall rope means connection guided around deflection pulleys, an improved cushioning effect is obtained which makes the treatment and the use of the treadmill more pleasant and less strenuous.

In accordance with a simple embodiment, the means for safely positioning the user is adapted to be operated with the aid of at least one winch. With the aid of such a winch, the first rope means can be operated in a simple manner.

According to an advantageous embodiment, the weights, which serve as counterweights, are implemented such that they can be dosed with the aid of at least one stop nail so that the treadmill can be operated more easily.

In accordance with an advantageous embodiment, all the features of the holding means, with the exception of the crane-like cantilever frames, are provided in pairs. An arrangement in pairs permits an individual adjustment of the body counterbalancing weights by means of various counterweights on both sides of the patient's body or of the user's body. Certain treatments are carried out more effectively or improved in this way.

In the following, the present invention will be explained in detail making reference to the drawings enclosed, in which:

DETAILED DESCRIPTION OF THE INVENTION

Figure 1:
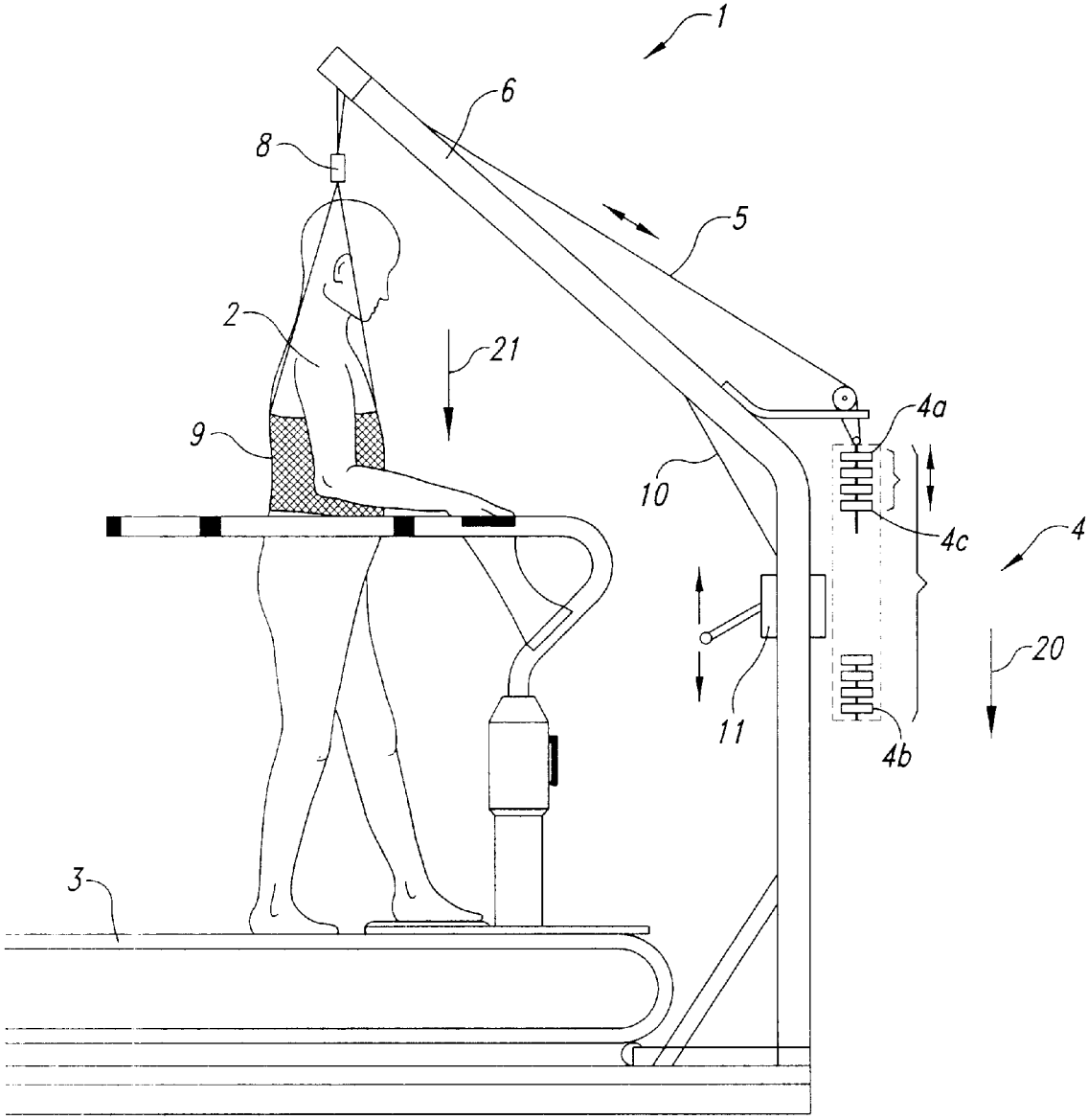
FIG. 1 shows a side view of a treadmill according to the present invention in a schematic representation.
Figure 2:
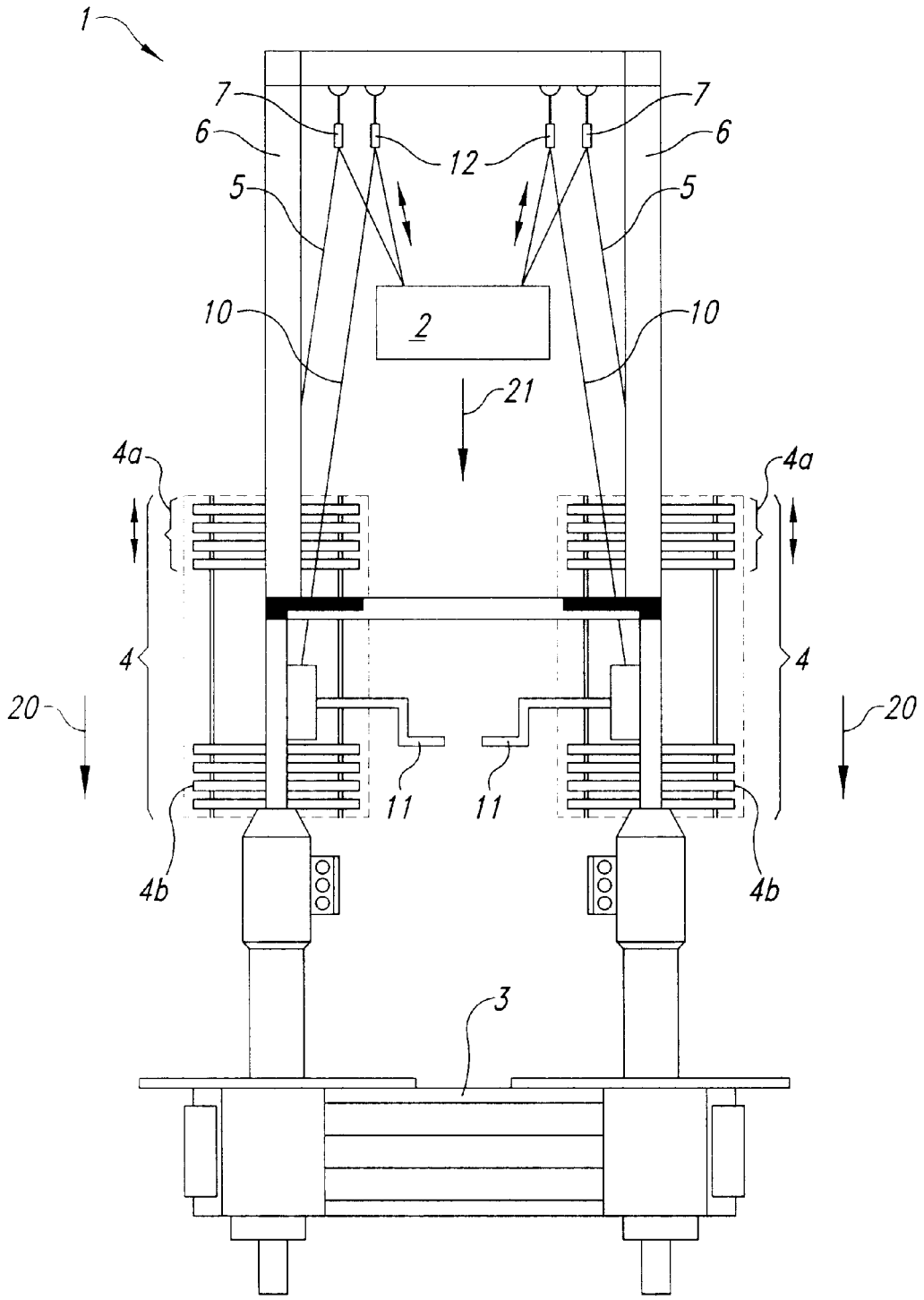
FIG. 2 shows a rear view of a treadmill according to the present invention in a schematic representation.

FIG. 1 shows a special embodiment of a present invention comprising holding means 1 for a user 2. FIG. 2 shows the same treadmill according to the present invention in a rear view. For the sake of clarity, the user 2 is only shown as a weight in FIG. 2.

The user 2 moves on the moving belt 3, which is shown in the figures as an endless moving belt. Such moving belts are described e.g. in DE 25 03 118 B2 and DE 42 38 252 C2 and can consist of interconnected tread lamellae. In the example shown, the user 2 is held by an abdominal belt 9 which is connected to one end of a flexible tensile element, such as a first rope means 10, the other end of said rope means being connected to a crank 11. The rope means 10 runs over a deflection pulley 12 on the crane-like cantilever frame 6. In addition, the abdominal belt 9 is connected to one end of a second flexible tensile element, such as a second rope means 5 whose other end has attached thereto a support means 4 for weights 4*a*, which can be added and removed one by one, as is known per se from conventional fitness devices in fitness centres. The second rope means 5 runs around a second deflection pulley 7 on said crane-like cantilever frame 6. The first and second rope means 10, 5, the support means 4 and the first and second deflection pulleys 12 and 7 are each provided in pairs so as to permit individual relief for both sides of the patient's body. The weight of the user 2 is designated by arrow 21, whereas the effective force of the counterweights is designated by arrow 20.

The user 2 is raised e.g. from a wheelchair to an upright position with the aid of the cranks 11 and the rope means 10. With the aid of a stop nail 4*c*, weights 4*a* can be secured in position in the support means 4 on the second rope means 5 by means of which the weight of the patient or of the user 2 is counterbalanced partly or fully. The counterweights 4*a* are taken from a reservoir 4*b* for weights.

During the walking or running movement of the user, an up and down movement is caused, which results in a corresponding up and down movement of the weights. It follows that the weight is constantly counterbalanced in each phase of movement.

The first rope means 10 and the second rope means 5 can also be formed by a single rope which is connected to the abdominal belt 9 of the patient 2 via a deflection pulley 8. In this way, a kind of pulley block is formed, which permits exact dosage of the counterweights 4*a* in relation to the weight of the patient's body. In the case of this embodiment, the second part of the rope means 5 is determined in a suitable manner at the beginning of the treatment of the patient and of the use of the device, respectively, when the patient is safely positioned with the aid of the rope means 10 and the winch 11.

It follows that the treadmill according to the present invention permits the weight of the patient's body to be counterbalanced and the stress on the patient's body to be adjusted, when a patient or user 2 is running or walking, with constant counterbalancing of the weight and constant stress on the patient's body independently of the up and down movements of the user.

When the tern weights is used in this description and in the claims, said term also comprises weight forces in general, such as those that can also be produced e.g. by adjustable springs.

What is claimed is:

1. A treadmill comprising a moving belt, a user holding apparatus for at least partially supporting and counterbalancing the weight of the user's body, wherein the user holding apparatus includes at least one support for weights which can be added one by one and which serve as counterweights and wherein the user holding apparatus has a connection device that includes a belt designed to encompass the user's torso, and a user positioning device coupled to the user holding apparatus for positioning the user relative to the moving belt, wherein the user positioning device comprises at least one first flexible tensile element, a first cantilever frame, and at least one first deflection pulley coupling the first flexible tensile element to the first cantilever frame.

2. The treadmill of claim 1 wherein the user holding apparatus further includes at least one second flexible tensile element, a second cantilever frame, and at least one second deflection pulley coupling the second flexible tensile element to the second cantilever frame, whereby the weight of the user acts on one end of the second flexible tensile element and the second cantilever frame, and the individually placed weights act on the other end of the second flexible tensile element when the treadmill is in operation.

3. The treadmill of claim 2, wherein the first and second cantilever frames are defined by a single frame having secured thereto said first and second deflection pulleys.

4. A treadmill comprising a moving belt, a user holding apparatus for at least partially supporting and counterbalancing the weight of the user's body, wherein the user holding apparatus includes at least one support for weights which can be added one by one and which serve as counterweights, at least one second flexible tensile element, a second cantilever frame, and at least one second deflection pulley, coupling the second flexible tensile element to the second cantilever frame, whereby the weight of the user acts on one end of the second flexible tensile element and the second cantilever frame, and the individually placed weights act on the other end of the second flexible tensile element when the treadmill is in operation; a user positioning device coupled to the user holding apparatus for positioning the user relative to the moving belt, wherein the user positioning device comprises at least one first flexible tensile element, a first cantilever frame, and at least one first deflection pulley coupling the first flexible tensile element to the first cantilever frame; and, a third deflection pulley having a connector secured thereto, said connector being connected to the first and second flexible tensile elements, the first and second flexible tensile elements being interconnected in such a way that the user is held by an overall system of flexible tensile elements extending from the support for weights and connected to the counterweights via the second deflection pulley, the third deflection pulley, and the first deflection pulley.

5. A treadmill comprising a moving belt, a user holding apparatus for at least partially supporting and counterbalancing the weight of the user's body, wherein the user holding apparatus includes at least one support which can be added one by one and which serve as counterweights, and a user positioning device coupled to the user holding apparatus for positioning the user relative to the moving belt, wherein the user positioning device comprises at least one first flexible tensile element, a first cantilever frame, and at least one first deflection pulley coupling the first flexible tensile element to the first cantilever frame, and is adapted to be operated with the aid of at least one winch.

6. The treadmill of claim 1 wherein the weights can be placed with aid of at least one stop nail.

7. The treadmill of claim 3 wherein with the exception of the single frame, all of the features of the user holding apparatus are provided in pairs.

* * * * *